US005089806A

United States Patent [19]

Willis et al.

[11] Patent Number: 5,089,806

[45] Date of Patent: Feb. 18, 1992

[54] BARRIER AND ALARM FOR BLOCKING A PASSAGEWAY

[75] Inventors: David T. Willis, North Reading, Mass.; Donald Farnsworth, Bridgewater, N.J.

[73] Assignee: Carriage Trade Company, Inc., Woburn, Mass.

[21] Appl. No.: 563,039

[22] Filed: Aug. 6, 1990

[51] Int. Cl.[5] ..... G08B 13/00

[52] U.S. Cl. ..... 340/541; 340/546; 340/548; 340/689

[58] Field of Search ..... 340/541, 548, 546, 564, 340/566, 665, 689, 825.31-825.36, 571; 116/77, 81, 94, DIG. 4; 200/61.45 R, 61.52

[56] References Cited

U.S. PATENT DOCUMENTS 4,005,397 1/1977 Blair ..... 340/576

4,808,974 2/1989 Cantley ..... 340/546

*Primary Examiner*—Donnie L. Crosland

*Attorney, Agent, or Firm*—Wolf, Greenfield & Sacks

[57] ABSTRACT

The apparatus described herein is a chain with a warning sign attached to it, that incorporates an audible alarm signal which is activated when a person moves the chain away from an egress that it is blocking, such as a supermarket check-out lane. The apparatus solves the problem of how to block a check-out lane so as to draw attention to any patron who is exiting the store by way of an unattended check-out lane, yet is a device that can be easily discarded from the egress, in the event of an emergency. The unique sign incorporates circuitry within. In the preferred embodiment, the sign is a sandwich with outer layers that have something appropriate printed on them, such as "ALARMED EXIT—For Emergency Use Only", and the inner, hidden portion contains an audible alarm, a battery, an arming switch and position sensitive contacts for detecting when an unauthorized person tampers with the barrier. The ON/OFF switch is available on the outside of the sign, but the switch is recessed and hard to locate if you don't know that it is there.

13 Claims, 2 Drawing Sheets

BARRIER AND ALARM FOR BLOCKING A PASSAGEWAY

FIELD OF THE INVENTION

This invention relates to a readily removable barrier for restricting passage through an aisle or egress such that an alarm incorporated within the barrier activated when a person moves the barrier.

BACKGROUND OF THE INVENTION

During business hours in supermarkets and the like, unattended check-out lanes need to be blocked so that people are forced to exit the store through one of the attended lanes. Presently, in some supermarkets, shopping carts, candy racks, or boxes are moved into unused lanes to block egress. However, such obstructions present a hazard in the event of an emergency. Other supermarkets put a chain up across unused check out lanes, but this is easy for a patron to pass through unnoticed.

Existing systems do not include barriers that are easy to put into place, indicate when a patron is moving the barrier, yet can be effortlessly put aside to clear the aisle for emergency use.

There are a number of prior art systems that disclose alarms which are triggered when an intruder attempts to break through a barrier. However, these systems are almost exclusively designed to protect against a burglar's intrusion, and, are not designed specifically for use in supermarket aisles or the like.

These systems are exemplified in U.S. Pat. No. 4,553,134, by Holt. It describes a spring loaded telescoping rod as a barrier across a window or other egress. One end of the rod holds an electric contact in place. A local or remote alarm is triggered when the contact is toggled by anyone tampering with the rod.

Another example is the security device described in U.S. Pat. No. 4,536,754, by Holce, et al. This device is based on a magnetic switch which is recessed into a wall, and able to accept the magnetized end of a barrier device. When the barrier chain is strung across the egress and the proper magnetic end is put into the hole containing the magnetic switch, the system is armed. Tampering with the barrier triggers a local or remote alarm.

Many such security systems are described in the prior art, however, neither of these systems or other prior art systems discloses an integrally formed barrier and motion sensor. Nor do any of the prior art devices work on the principle of a local alarm that is useful in supermarkets and like situations in which the barrier itself must be immediately removable, in the case of an emergency, by the person who is going through the egress, and in which installation and removal of the alarm must be simple and quickly done.

SUMMARY OF THE INVENTION

The prior art systems referred to above do not disclose supermarket barriers that are easy to put into place, carry notices warning patrons that the aisle is closed to thru-traffic, and trigger alarms when the barrier is disturbed, yet can be effortlessly put aside to clear the aisle for emergency use.

Therefore, an object of this invention is to provide a barrier for a passageway that is easy to install, set up, and disconnect across an aisle or egress.

It is a further object of this invention to provide a sign that is integrally formed with alarm circuitry to give a local warning when anyone disturbs the sign.

Another object of this invention is to provide a barrier mechanism with alarm circuitry that can easily be armed and disarmed by an attendant.

It is still a further object of this invention to provide an inexpensive means to block an egress from general use, by means of a local alarm which preferably is a loud audio alarm.

These and other objects are achieved in a chain barrier that has a unique sign hung from it, which incorporates circuitry that includes an audible alarm, a battery, an arming switch, and position sensitive contacts for detecting when an unauthorized person tampers with the barrier.

In the preferred embodiment, the sign is a sandwich with outer layers that have something appropriate printed on them, such as "ALARMED EXIT—For Emergency Use Only". The inside contains position detection circuitry, alarm means and a battery.

The sign is constructed to keep the circuitry concealed and unavailable to non service persons.

An ON/OFF switch may be positioned on the outside of the sign in a recessed and concealed or hard to locate position. Alternately, the switch may be key operated.

The sign is permanently attached to a chain. The chain spans the aisle or egress that is to be blocked. The egress has suitable means such as two eye hooks, or two metal plates, or two smooth surfaces, or some combination thereof, on the vertical walls that define the aisle, so that the chain can be hooked into the eye hooks, or affixed by magnets or suction cups to the walls on each side of the aisle or egress.

In use the chain is secured across the aisle by the above mentioned means with the sign level and motionless. The ON/OFF switch is then set to ON.

The barrier is now armed and actively in use. If a patron disregards the warning sign and goes through the barrier, slight movement of the sign will trigger the audible alarm, and attract the supermarket personnel to the unauthorized use of the aisle.

BRIEF DESCRIPTION OF THE DRAWING

In order that the invention may be fully understood, it will now be described by way of example and with reference to the accompanying drawing in which.

DETAILED DESCRIPTION

Figure 1:
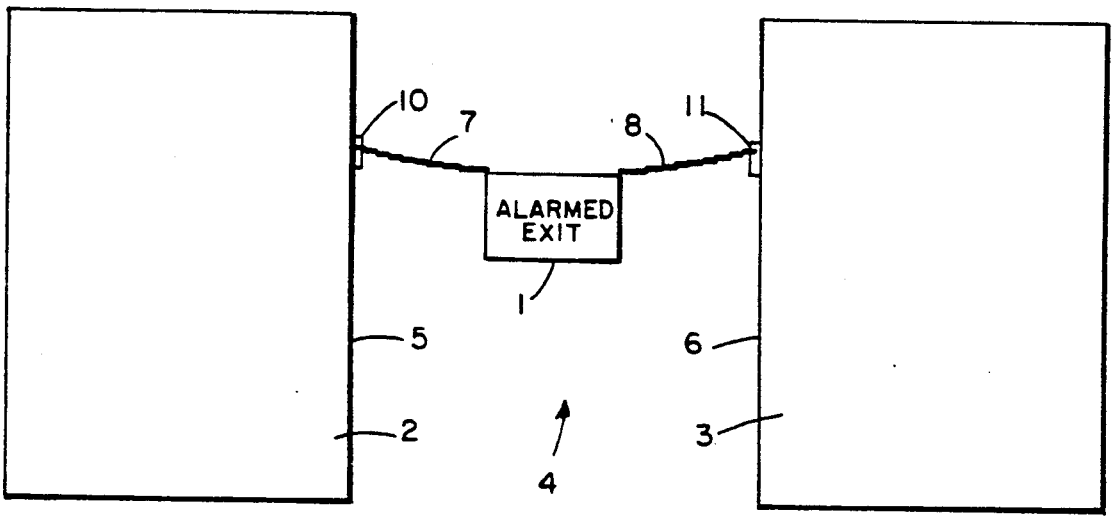
FIG. 1 is a front view of a supermarket check out lane with the barrier device in place to block through traffic.

The drawings illustrate the preferred embodiment for use in a supermarket or the like. In this arrangement, a sign 1 is removably suspended between two check-out counters 2 and 3 or the like forming a check out aisle 4. The counters 2 and 3 may take any form and may or may not be provided with full side walls 5 and 6 provided some means are available from which the sign 1 may be suspended.

In the preferred embodiment, the sign 1 has suitable lengths of chain 7 and 8 or the like, secured permanently to opposite upper corners. The lengths of these chains should be long enough to suspend the sign 1 across the aisle 4 preferably just below the counter top. In general chain lengths 7 and 8 of about 1' to 3' are sufficient. Obviously, the length of the chain lengths 7 and 8 will vary depending upon the width of the aisle. If desired means may be incorporated into the system to permit adjustment of these lengths. Means for securing the chains and for adjusting the length are well known in the art. Other suspension means are also contemplated. For example, a single length chain extending through loops in the sign 1 may be used.

The free end of chain 7 is secured to vertical wall 5 by means of a magnet, hook-and-eye, suction cup, or some other easy to fasten and unfasten means 10. The other free end of chain 8 is secured to vertical wall 6 by means of a magnet, hook-and-eye, suction cup, or some other easy to fasten and unfasten means 11. In an alternate embodiment, one chain may be permanently secured to a wall 5 or 6 if desired. The sign 1 is positioned near the center of the check out aisle, so that patrons may read it and be deterred from proceeding through.

Figure 2A:
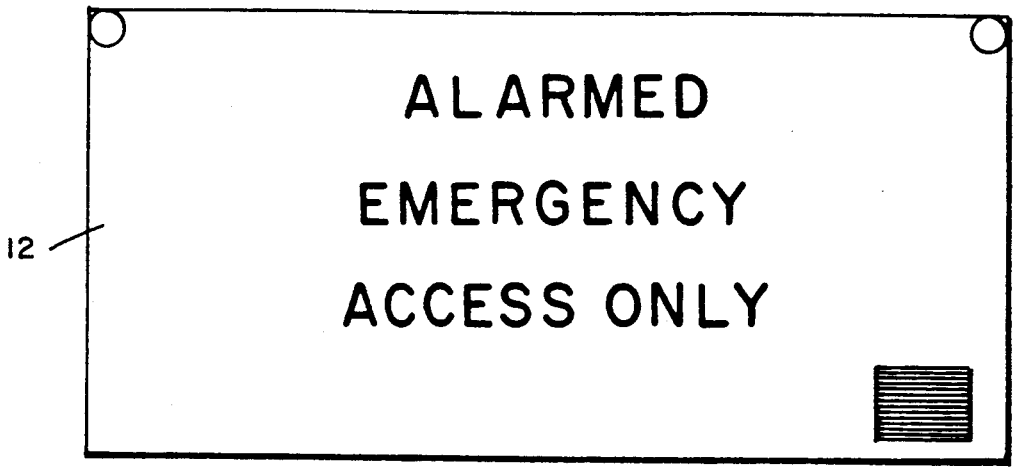
FIG. 2A is a view of one side of the barrier sign.
Figure 2B:
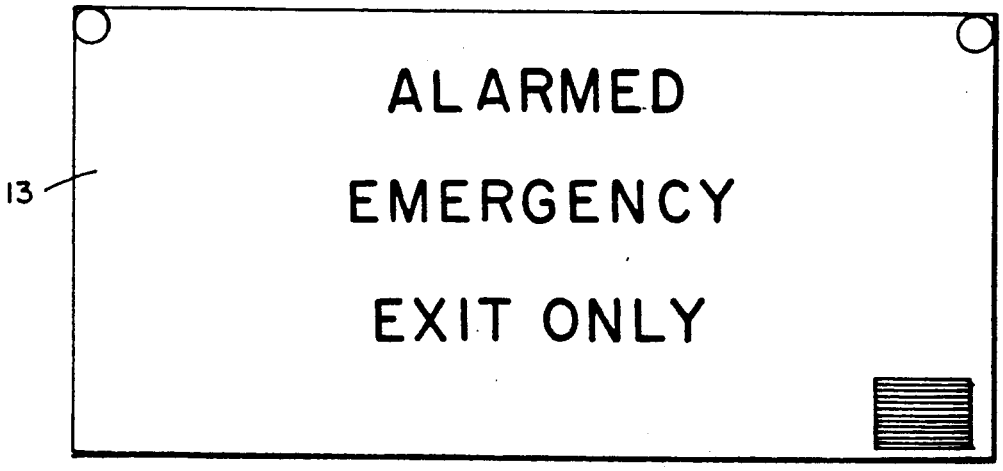
FIG. 2B is a view of the other side of the barrier sign.

In this preferred embodiment, the sign may have the same message, "ALARMED—EMERGENCY ACCESS ONLY", printed in bold letters on both of sides 12 and 13, as shown in FIGS. 2A and 2B. Obviously, the information printed on the sign may be varied in accordance with the specific use for which the barrier is designed.

The circuitry 20 of the sign is positioned within the sign 1, between outer surfaces 12 and 13. The sign may comprise a shallow box having a thickness sufficient to contain the various components described and may be suitably formed of metal or plastic with one of the surfaces 12 or 13 forming a cover, and the other surface as the back of the shallow box. The cover may be secured to the sidewalls (not shown) by suitable means such as corner screws or the like to form a hollow interior, within which the circuitry is contained. Contained within the sign are position sensitive mercury switches 20, signalling means 21, a battery 22, a printed circuit board (PCB) 23, and an ON/OFF switch 24, suitably wired to cause the alarm 21 to sound when the sign 1 is moved sufficiently to close one or both of the switches 20 when the system is on.

The ON/OFF switch 24 is accessible from the outside of the sign, but is recessed and, therefore, hard to locate if you don't know that it is there. Alternately, it may be key operated to prevent unauthorized disarming.

The alarm is set by the following sequence of events: An attendant connects one end of the chain to wall 5 by one of the above-mentioned means, then connects the other chain to the wall 6 by the same or another of the above mentioned means. The ON/OFF switch 24 is set to ON to activate the alarm circuitry, and simultaneously sign 1 is levelled, and made motionless.

The circuitry on the PCB has an alarm delay circuit to allow the attendant a few seconds to adjust the sign after the ON/OFF switch is set to ON. After that delay time the barrier is armed and actively in-use. At that time, the contacts of mercury switches 20 are both open. Any jiggling of the sign from its level position will cause one or both of the mercury switches 20 to close. This causes circuitry on PCB 23 to activate signalling means 21 to emit an 80 db sound for six seconds.

Figure 3:
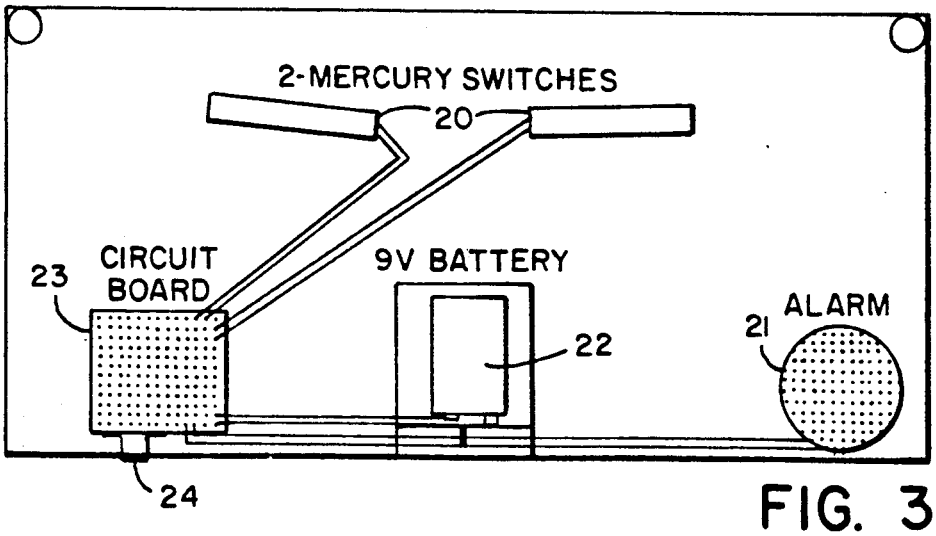
FIG. 3 is a cross sectional view schematically illustrating the contained within the barrier sign.

After the six second alarm the circuitry resets itself. If the sign has returned to its level position, then mercury switches 20 will be open and alarm 21 will not be reactivated. However, if the sign is still out of plumb after the six second alarm, then at least one of the mercury switches 20 will still be closed, and the signalling means will give off another six second 80 db blast. The circuit illustrated in FIG. 3 has the components simply wired as illustrated by wiring 30. The circuit board 23 is designed with appropriate components to effect the delays referred to above in accord with known practice.

The loud audible sound of the alarm is intended to attract the attention of supermarket personnel to the person who is going through the barrier. The alerted personnel may then determine if the situation constitutes an emergency that warrants disregarding or turning off the alarm, or whether other action is required.

It should be obvious to anyone practiced in the art, that although one embodiment of the aisle barrier has been shown herein, there are many variations that can be made without departing from the teaching of this invention. One such variation is to arrange the delay and duration timing of the alarm differently. Another variation contemplates use of something other than a chain (e.g., electrical wire, rope, cable) to support the sign. Another modification contemplates a signalling means and power source in the bulkhead, while only the motion detector and sign are on the barrier. Another embodiment contemplated is the use of a flashing light or some other means than an audible alarm. Other variations contemplate use of different fastening means for securing the ends of the chain to the aisle walls. Accordingly the invention is defined not by the illustrative embodiment, but only by the following claims and their equivalents.

What is claimed is:

1. An alarm system to detect movement of a body through a narrow egress, such as a supermarket aisle and the like, comprising a removable barrier, shaped to occupy only a portion of said egress when positioned therein, and a motion-sensitive alarm supported on said barrier, said alarm adapted to be triggered on movement thereof.

2. An alarm system as set forth in claim 1, wherein said alarm includes signalling means and circuit means including a motion-sensitive switch connected to, and controlling said signalling means, and means supporting said alarm on said barrier.

3. An alarm system according to claim 2, wherein said motion-sensitive switch includes a mercury switch.

4. An alarm system according to claim 2, wherein said signalling means, circuit means and motion-sensitive switch are all contained within the alarm and power supply means is also contained within the self-contained alarm.

5. An alarm system according to claim 4, wherein said alarm includes a container having sign bearing surfaces.

6. An alarm system according to claim 4, wherein said signalling means is an audio alarm.

7. An alarm system to detect movement of a body through a narrow egress, such as a supermarket aisle and the like, comprising a removable barrier including a flexible member having at least one end that is readily disengageable from a support, and a motion-sensitive alarm supported on said barrier, said alarm adapted to be triggered on movement thereof.

8. An alarm system according to claim 7, wherein said flexible member is engaged to said support by a mechanical hook.

9. An alarm system according to claim 7, wherein said flexible member is engaged to said support by a suction cup.

10. A method of preventing undetected egress from a supermarket aisle and the like through a normal egress such as a check-out aisle unmonitored by humans, comprising, extending a readily removable barrier across only a portion of said egress and attaching a motion-sensitive alarm to said barrier so that movement of said barrier triggers said alarm.

11. A method as set forth in claim 10, including positioning a warning signal in said egress.

12. A method as set forth in claim 11, including a method for giving an audio warning when movement of said barrier triggers said alarm.

13. An alarm system to detect movement of a body through an aisle defined by at least two spaced-apart walls, said alarm system comprising, a removable barrier, the barrier attached to said walls across the aisle, and a motion-sensitive alarm supported on said barrier, said barrier shaped to occupy a portion of said aisle when positioned therein, said alarm adapted to be triggered on movement of the barrier.

* * * * *